US005392551A

United States Patent [19]

Simpson

[11] Patent Number: 5,392,551

[45] Date of Patent: Feb. 28, 1995

[54] SINGLE USE FIREARM SAFETY DEVICE

[76] Inventor: David F. Simpson, P.O. Box 7, Fort Shaw, Mont. 59443-0007

[21] Appl. No.: 147,667

[22] Filed: Nov. 3, 1993

[51] Int. Cl.[6] ..... F41D 17/54

[52] U.S. Cl. ..... 42/70.07

[58] Field of Search ..... 42/70.07, 70.11, 70.06

[56] References Cited

U.S. PATENT DOCUMENTS

| | | | |
|---|---|---|---|
| 2,664,658 | 1/1954 | Bjorklund | 42/70.07 |
| 3,164,919 | 1/1965 | Hall | 42/70.07 |
| 3,637,180 | 1/1972 | Parry | 42/70.07 |
| 4,030,221 | 6/1977 | Doobenen et al. | 42/70.07 |
| 4,412,397 | 11/1983 | Bays | 42/70.11 |
| 4,499,681 | 2/1985 | Bako et al. | 42/70.07 |
| 4,509,281 | 4/1985 | Dreiling et al. | 42/70.07 |
| 4,934,083 | 6/1990 | Smith | 42/70.07 |
| 4,995,180 | 2/1991 | Tucker et al. | 42/70.07 |
| 5,050,328 | 9/1991 | Insko | 42/70.07 |

*Primary Examiner*—David Brown
*Attorney, Agent, or Firm*—Dorsey & Whitney

[57] ABSTRACT

A fractionable trigger lock that prevents accidental discharge of a firearm. The device comprises two side guards which fit within the trigger guard of a firearm and are held together by a spindle with a fractionable connection. When in place, the trigger may not be engaged. To gain access to the trigger, a force must be exerted to the spindle in order to sever the connections between the spindle and side guard, thus releasing the trigger lock from the trigger.

14 Claims, 2 Drawing Sheets

SINGLE USE FIREARM SAFETY DEVICE

BACKGROUND OF THE INVENTION

1. Field of the Invention

The invention relates to firearm safety devices, more side particularly devices which prevent access to or operative engagement of the trigger of a firearm.

2. Description of the Prior Art

A number of devices have been disclosed which can be used to prevent the unwanted or unauthorized use of a firearm. One type of device is disclosed in U.S. Pat. No. 2,664,658 and comprises two members designed to mate around and immobilize the trigger. The two members are secured on the firearm by a locking mechanism which holds the members in place around the trigger. The device requires the use of a key to operate the locking mechanism. U.S. Pat. No. 4,509,281 discloses a gun locking device comprising two members constructed to mate around a gun trigger. The members are secured on the gun by a shaft and socket which must be turned axially in opposite directions to remove the locking device. The device disclosed in U.S. Pat. No. 4,995,180 comprises two jaws for restraining the movement of various components of a firearm, including the trigger. The jaws are pivotable toward and away from each other and can be moved by operation of a cam means which is secured by a locking mechanism.

These devices require numerous parts for their construction. The more side parts in the device, the greater the expense of the device. Similarly, more parts increase the weight of the device. Especially in the case of smaller firearms, such as handguns, the device may add significantly to the weight of the firearm, hampering transport to a greater or lesser degree. Many of these devices also require the use of a key to operate a locking mechanism.

U.S. Pat. No. 4,412,397 discloses a firearm safety kit designed to be secured to various areas of a firearm and to immobilize one or more parts of the firearm necessary for operation. The device comprises a fracturable strap and a means for securing the fracturable strap about the firearm thereby preventing a part of the firearm from moving into a "ready-fire" position. The device does not however, prevent access to the area surrounding the trigger and thus to the trigger. Further, operation of the device may not be apparent to the user without detailed instructions for each type of firearm on which the device could be used.

Thus, there is a need for a firearm safety device which prevents access to the trigger of a firearm while the device is in place on the firearm and which is simple in construction. There is a further need for the device to be self evident in operation to the intended user.

SUMMARY OF THE INVENTION

The invention relates to a firearm safety device, for use with a firearm, the firearm having a trigger, and a trigger guard partially enclosing the trigger and providing a first and second opening to the trigger. The safety device has a first side guard, configured to substantially cover the first opening to the trigger, and a spindle connected thereto by a spindle connection. The device also has a second side guard, configured to substantially cover the second opening to the trigger, and a spindle hub, for receiving and engaging the spindle, connected thereto by a hub connection. The spindle connection, the hub connection or both are fracturable connections.

Insertion of the spindle through the trigger guard and into the spindle hub causes the first and second side guards to substantially cover the first and second openings to the trigger, thus preventing access to the trigger, and access to the trigger may be regained by fracturing the spindle connection or the hub connection or both.

The spindle connection between the first side guard and the spindle may have one or more, preferably four, fracturable spokes. The hub connection between the second side guard and the spindle hub may have one or more, preferably four, fracturable spokes.

The spindle may have a circumferentially oriented flange connected thereto at a point along the length of the spindle, and the spindle hub may have a flange receiving space inside the spindle hub. The spindle may also have more than one circumferentially oriented flange connected thereto at points along the length of the spindle, the spindle hub having at least as many flange receiving spaces. The flange receiving spaces are positioned along the spindle hub to simultaneously engage the flanges upon insertion of the spindle into the spindle hub.

The first side guard may have one or more posts mounted on the first side guard and the one or more posts may be configured to engage the trigger guard of the firearm when the first side guard is inserted into the trigger guard. The second side guard may also have one or more posts mounted on the second side guard and the one or more posts may be configured to engage the trigger guard of the firearm when the second side guard is inserted into the trigger guard.

The first side guard may have one or more grip tabs at or near the periphery of the first side guard, the grip tabs being configured to engage the trigger guard of the firearm when the spindle on the first side guard is inserted into the trigger guard. The second side guard may have one or more grip tabs, the grip tabs placed at or near the periphery of the second side guard, the grip tabs configured to engage the trigger guard of the firearm when the spindle hub on the second side guard is inserted into the trigger guard.

The invention also relates to a firearm safety device, for use with a firearm, the firearm having a trigger, and a trigger guard partially enclosing the trigger and providing a first and second opening to the trigger. The safety device has a first side guard configured to substantially cover the first opening to the trigger and a spindle connected thereto by a spindle connection, the spindle connection has four fracturable spokes. The safety device also has a second side guard configured to substantially cover the second opening to the trigger and a spindle hub, for receiving and engaging the spindle, connected thereto by a hub connection, the hub connection having four fracturable spokes. The second side guard also has two posts attached thereto, the two posts extending in the same direction as the spindle hub and configured to engage the trigger guard. Insertion of the spindle through the trigger guard and into the spindle hub causes the first and second side guards to substantially cover the first and second openings to the trigger, thus preventing access to the trigger, the two posts serving to stabilize and prevent movement of the device while assembled onto the firearm, and whereby access to the trigger may be regained by fracturing the spindle connection or the hub connection or both.

DETAILED DESCRIPTION OF THE INVENTION

Figure 1:
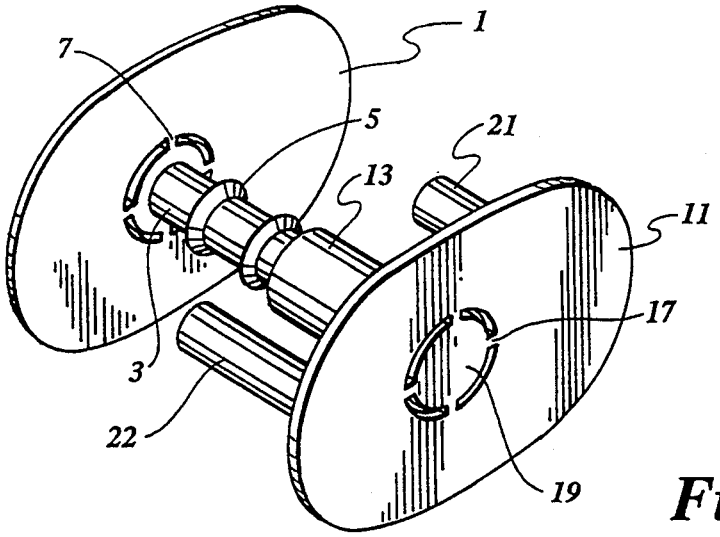
FIG. 1 is a perspective view of a firearm safety device constructed according to the invention prior to assembly of the pieces.
Figure 2:
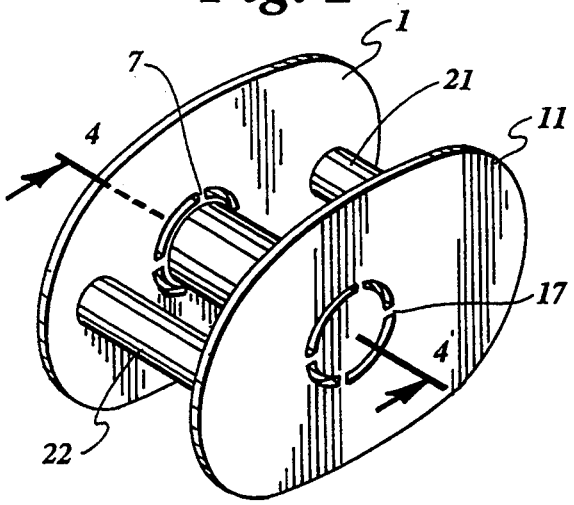
FIG. 2 is a perspective view of a firearm safety device constructed according to the invention after assembly of the two side guards.

Firearm safety devices in accordance with the invention are depicted in FIGS. 1–6. FIG. 1 shows one embodiment of the invention prior to the assembly of the device. A first side guard (1) is shown with a spindle (3) and a second side guard (11) is shown with a spindle hub (13) and two posts (21). Assembly of the device comprises inserting the spindle into the spindle hub a sufficient distance to allow the spindle to engage the spindle hub and prevent the removal of the spindle. FIG. 2 shows the embodiment of FIG. 1 after insertion of the spindle into the spindle hub.

Figure 3:
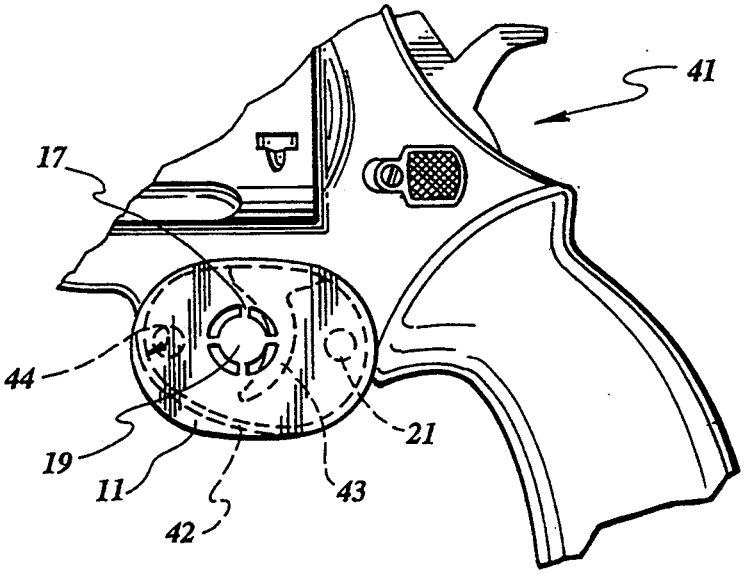
FIG. 3 is a side view of a firearm safety device constructed according to the invention after assembly of the firearm safety device within the trigger guard of a firearm.

The placement of the safety device on a handgun (41), specifically a revolver, is shown in FIG. 3. The handgun has a trigger (43) partially enclosed by a trigger guard (42). The trigger guard (42) thus defines an area around the trigger (43) providing an opening on either side of the handgun to gain access to the trigger (43). The trigger guard (42) has an interior surface (44) defined by the surface of the trigger guard closest to the trigger. In FIG. 3, a side guard is shown in contact with the trigger guard and surfaces on the firearm in the vicinity of the trigger guard. Access to the area within the trigger guard and therefore the trigger (43) itself is prevented while the device is in place. Two posts ((21) and (22)) are mounted on one of the side guards. In the embodiment, the posts are in contact with the trigger guard (42).

Figure 5:
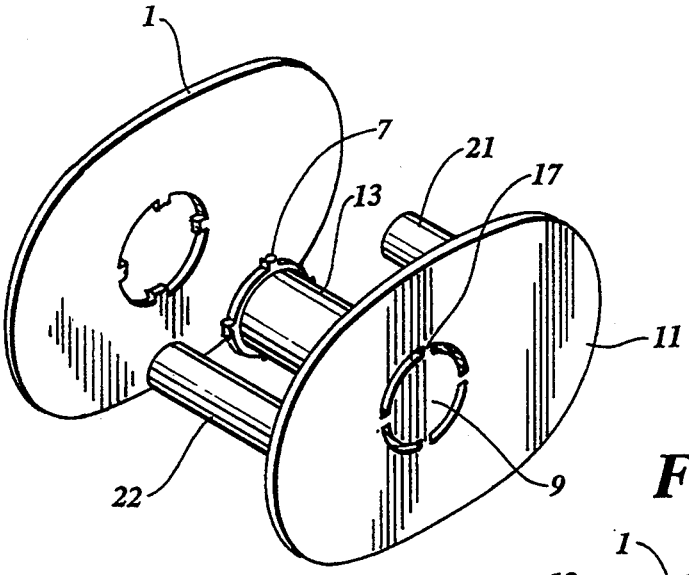
FIG. 5 is a perspective view of a firearm safety device constructed according to the invention after separation of a side guard from a spindle.

The device is removed by application of pressure in the vicinity of the central area (19) of either side guard ((1) or (11)) causing the fracturable connection ((7) or (17)) between the side guard and the spindle or spindle hub to fracture. The fracture of the connection allows the two side guards (1 and 11 ) to separate and fall away from the trigger guard area. FIG. 5 shows embodiment of the invention shown in FIG. 2 after separation of the spindle (3) from its side guard (1).

There is virtually no restriction on the type of firearm for which a device according to the invention may be constructed. For example, handguns (including semi-automatic and revolvers), long guns (including rifles and shotguns) all can be temporarily disabled using the device. Other types of firearms including pellet guns and BB guns may also be disabled. A device employing the present invention may even be constructed for disabling weapons such as crossbows. Based on the teachings of this specification, changes in the design of the device to allow its use on these weapons will be obvious to those skilled in the art. In the discussion contained in this specification, the term "firearm" should therefore be understood to include all such weapons.

The side guards of the device may be produced by injection molding of plastic, for example polystyrene. Injection molding enables a manufacturer to produce the device in an inexpensive manner and to more easily adapt the features of the device to conform to the specifications of virtually any firearm possessing a trigger guard. The construction of the side guards can be varied according to the shape of the trigger guard of the firearm to which the device of the invention will be applied.

Figure 4:
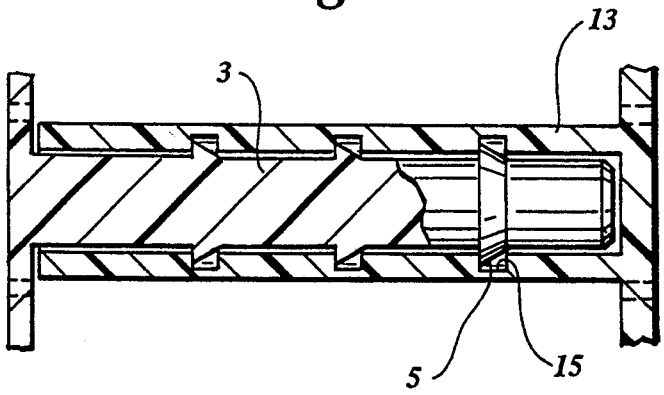
FIG. 4 is a cross section of a firearm safety device constructed according to the invention taken at 4—4 of FIG. 2.

The spindle and spindle hub are constructed in a manner that will prevent the removal of the spindle hub at any time after the insertion of the spindle (that is, an irreversible connection). In a preferred embodiment, shown in FIG. 1, the spindle is constructed as a solid cylinder with one or more flanges (5) oriented circumferentially on the spindle (3) and the spindle hub (13) is constructed as a hollow cylinder with a series of notches or flange receiving spaces (15) spaced to receive the flanges on the spindle. FIG. 4 shows a cross section of the device of the invention in which the spindle (3) has been fully inserted into the spindle hub (13) and illustrates the relationship of the flanges (5) and the flange receiving spaces (15). It will be appreciated by those skilled in the art that there are many such irreversible connections that can be used in a device employing the present invention. For example, the spindle need not be a solid cylinder.

The spindle, the spindle hub or both are fracturably attached to their respective side guards. These connections are referred to as the spindle connection or the hub connection respectively. The particular method of constructing the fracturable connections is not important to the invention, as long as the connections fracture upon application of pressure to the center area (19) of one of the side guards ((1) or (11)). It is desirable to make these fracturable connections strong enough to prevent their fracture by young children. In a preferred embodiment, the spindle connection or the hub connection are each constructed as four fracturable spokes and the side guard, the spokes and the spindle or the spindle hub, as the case may be, are formed as one piece during injection molding. The thickness of the spokes may be varied to increase the amount of pressure needed to fracture all of the spokes on one of the side guards. The material used to construct the device can also be varied to achieve stronger spokes.

In another alternative embodiment, the spokes may be made of a different material embedded in the side guard and extending into or through the spindle or spindle hub to create a fracturable spoke. In a further alternative embodiment, a side guard may be constructed in which a side guard and spindle or spindle hub are attached by a substantially continuous weakened region of the side guard, wherein the weakened region is formed by decreasing the thickness of the side guard in the vicinity of the spindle or spindle hub. The weakened region may also be scored to facilitate fracture of the connection.

The placement of the spindle and spindle hub on their respective side guards can be varied according to the shape of the trigger guard of a particular firearm. As shown in FIG. 3, the side guards of the device can be constructed so that the spindle and spindle hub are aligned in front of the trigger when the device is assembled onto a firearm. Alternatively, the side guards of the device can be constructed so that the spindle and spindle hub align behind the trigger when assembled onto a firearm. Further, it should also be understood that the side guards may have more than one spindle or spindle hub, as the case may be, to secure the device embodying the invention to the firearm. Finally, it should be understood that there is no requirement that either the spindle or the spindle hub contact the trigger while assembled onto a firearm.

One or more posts may also be affixed to either of the side guards of a device of the invention. The posts may serve as spacers and may be approximately the same length as the spindle or spindle hub, as the case may be. The posts may also serve to stabilize a device embodying the invention. In this case, the placement of the one or more posts is dictated by the particular firearm to which the device is to be assembled onto and the shape of the trigger guard. When the device is assembled onto a firearm, the one or more posts contact the inner surface of the area defined by the trigger guard thus further immobilizing the device and preventing movement of the device while assembled onto the firearm. Alternatively, one or more posts may contact an external surface of the trigger guard.

Figure 6:
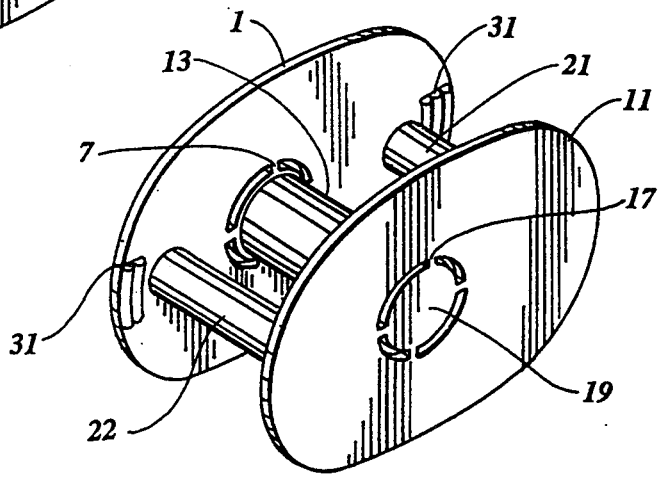
FIG. 6 is a perspective view of a firearm safety device constructed according to the invention after assembly of the two side guards and shows the placement of trigger guard grip tabs on the side guard of the first side guard.

Stabilization of the device after assembly onto a firearm may be achieved by addition of grip tabs (31) to one or both side guards. Grip tabs may be placed along the periphery of the side guard to engage the trigger guard of the firearm. The grip tabs may engage the trigger guard on either an external or internal surface. Grip tabs may also be employed in pairs, as shown in FIG. 6, to simultaneously engage both sides of the trigger guard. Multiple grip tabs may be placed in parallel at the periphery of one or both side guards to allow the device of the invention to be used on different firearms. The grip tabs may also be designed to engage other surfaces on the firearm within the area defined by the trigger guard, for example the underside of the firearm immediately adjacent to the trigger.

It should be understood that various modifications and substitutions can be made by those skilled in the art without departing from the spirit and scope of the invention, and that all such modifications and substitutions are included in the scope of the invention as defined in the following claims.

I claim:

1. A firearm safety device, for use with a firearm, said firearm having a trigger, and a trigger guard partially enclosing said trigger and providing a first and second opening to said trigger, said safety device comprising:

(a) a first side guard configured to substantially cover said first opening to said trigger and having a spindle connected thereto by a spindle connection; and (b) a second side guard configured to substantially cover said second opening to said trigger and having a spindle hub, for receiving and engaging said spindle, connected thereto by a hub connection, said spindle connection or said hub connection or both being fracturable connections, whereby insertion of said spindle through said trigger guard and into said spindle hub causes said first and second side guards to substantially cover said first and second openings to said trigger, thus preventing access to said trigger, and whereby access to said trigger may be regained by fracturing said spindle connection or said hub connection or both.

2. The invention of claim 1, wherein said first side guard further comprises one or more grip tabs at or near the periphery of said first side guard and configured to engage said trigger guard of said firearm when said spindle on said first side guard is inserted into said trigger guard.

3. The invention of claim 1, wherein said second side guard further comprises one or more grip tabs, said grip tabs placed at or near the periphery of said second side guard and configured to engage said trigger guard of said firearm when said spindle hub on said second side guard is inserted into said trigger guard.

4. The invention of claim 1, wherein said spindle connection comprises one or more fracturable spokes.

5. The invention of claim 4, wherein said spindle connection comprises four fracturable spokes.

6. The invention of claim 1, wherein said hub connection comprises one or more fracturable spokes.

7. The invention of claim 6, wherein said hub connection comprises four fracturable spokes.

8. The invention of claim 1, wherein said spindle further comprises a flange circumferentially connected thereto at a point along the length of said spindle, and said spindle hub further comprises a flange receiving space inside said spindle hub.

9. The invention of claim 8, wherein said spindle has more than one circumferentially oriented flange connected thereto along the length of said spindle, and said spindle hub has at least as many flange receiving spaces, said flange receiving spaces positioned along said spindle hub to simultaneously engage said flanges upon insertion of said spindle into said spindle hub.

10. The invention of claim 1, wherein said first side guard further comprises one or more posts mounted on said first side guard.

11. The invention of claim 10, wherein said one or more posts are configured to engage said trigger guard of said firearm when said first side guard is inserted into said trigger guard.

12. The invention of claim 1, wherein said second side guard further comprises one or more posts mounted on said second side guard.

13. The invention of claim 12, wherein said one or more posts are configured to engage said trigger guard of said firearm when said second side guard is inserted into said trigger guard.

14. A firearm safety device, for use with a firearm, said firearm having a trigger, and a trigger guard partially enclosing said trigger and providing a first and second opening to said trigger, said safety device comprising:

(a) a first side guard configured to substantially cover said first opening to said trigger and having a spindle connected thereto by a spindle connection, said spindle connection comprising four fracturable spokes; and (b) a second side guard configured to substantially cover said second opening to said trigger and having a spindle hub, for receiving and engaging said spindle, connected thereto by a hub connection, said hub connection comprising four fracturable spokes, said second side guard also having two posts attached thereto, said two posts extending in the same direction as said spindle hub and configured to engage the trigger guard upon insertion into said first or second opening, whereby insertion of said spindle through said trigger guard and into said spindle hub causes said first and second side guards to substantially cover said first and second openings to said trigger, thus preventing access to said trigger, the two posts serving to stabilize and prevent movement of the device while assembled onto the firearm, and whereby access to said trigger may be regained by fracturing said spindle connection or said hub connection or both.

* * * * *